US005388816A

United States Patent [19]

Petersen

[11] Patent Number: 5,388,816

[45] Date of Patent: Feb. 14, 1995

[54] METHOD AND APPARATUS TO OPEN FOLDED SHEETS OR PACKAGES OF SHEETS

[75] Inventor: Godber Petersen, Augsburg, Germany

[73] Assignee: Man Roland Druckmaschinen AG, Augsburg, Germany

[21] Appl. No.: 90,742

[22] Filed: Jul. 13, 1993

[30] Foreign Application Priority Data

Jul. 16, 1992 [DE] Germany ..... 4223404

[51] Int. Cl.[6] ..... B65H 5/30

[52] U.S. Cl. ..... 270/57

[58] Field of Search ..... 270/54, 55, 57

[56] References Cited

U.S. PATENT DOCUMENTS

| | | | |
|---|---|---|---|
| 3,420,516 | 1/1969 | Guggisberg | 270/55 |
| 3,450,400 | 6/1969 | Guggisberg | 270/55 |
| 4,840,365 | 6/1989 | Kobler et al. | 270/54 |
| 5,050,851 | 9/1991 | Eugster | 270/55 |
| 5,065,994 | 11/1991 | Hatt | 270/55 |
| 5,129,781 | 7/1992 | Petersen | 270/54 X |
| 5,165,674 | 11/1992 | Petersen | 270/54 X |

FOREIGN PATENT DOCUMENTS

| | | | |
|---|---|---|---|
| 1224329 | 9/1966 | Germany . | |
| 1285449 | 12/1968 | Germany | 270/54 |
| 1296146 | 5/1969 | Germany . | |
| 3621832 | 9/1987 | Germany . | |

*Primary Examiner*—Edward K. Look
*Assistant Examiner*—John Ryznic
*Attorney, Agent, or Firm*—Frishauf, Holtz, Goodman & Woodward

[57] ABSTRACT

Folding and transport devices wherein the crease of a folded sheet (5) does not extend completely over the length of the fold so that an open loop is formed at one end of the crease. Fingers (25 to 28) can be laterally inserted into the open loop in order to be able to open the folded sheets (5) again without a side fold strip. The folded sheets (5) are normally conveyed to designated positions, but they are opened while their conveyance is halted, so that there is sufficient time for opening them. The folded sheets (5) are opened by insertion needles (16) and V-shaped opening plates (19) while they are simultaneously kept in alignment by stops (14) and grasped by grippers (18).

19 Claims, 11 Drawing Sheets

METHOD AND APPARATUS TO OPEN FOLDED SHEETS OR PACKAGES OF SHEETS

Reference is made to the following related patents, assigned to the assignee of the present invention, the disclosure of which is hereby incorporated by reference:

U.S. Pat. No. 4,840,365 issued Jun. 20, 1989

U.S. Pat. No. 5,129,781 issued Jul. 14, 1992

U.S. Pat. No. 5,165,674 issued Nov. 24, 1992.

1. Field of the Invention

The invention relates to a method and apparatus to open folded sheets or packages of sheets, wherein the folded sheets each have an open loop between the sheet halves. When reference is made hereinafter and in the claims to "sheet" it is to be understood that the singular form is used merely for convenience and is to include packages of sheets, for example, numerous folded sheets, for instance newspapers.

2. Background

Folding and transport devices are already known, wherein the fold of the folded sheet does not extend completely over the length or width of the sheet to be folded, so that an open loop is formed on one side of the folded sheet, into which fingers can be laterally inserted to make it possible to open the folded sheet again without providing a side fold strip. From U.S. Pat. No. 5,165,674 it is known to open a folded sheet by spreading it in order to convey it in such spread form to a subsequent transport or storage system, for example a moving zig-zag carrier structure. During transport at a speed which is already considerably reduced in comparison with known devices, the folded sheets are briefly opened by the lateral insertion of controlled grippers into the open loops in the fold of the folded sheets, so that they can be subsequently stored in the zig-zag carrier structures, such as are known from U.S. Pat. No. 4,840,365.

A disadvantageous aspect of this device is that opening of the folded sheets takes place as it is moving because this leaves a very limited time available for opening the folded sheets and, particularly with thin paper, opening of the folded sheets is, thus, not possible at higher speeds.

THE INVENTION

It is an object of the present invention to avoid the disadvantages of the known devices and to provide a new method and apparatus for opening folded sheets.

This and other objects are attained with a method and apparatus according to which a plurality of engagement means are simultaneously or one after another inserted into the open loop of a folded sheet during the time when transport of the sheet is halted. Each insertion is operated for a plurality of sheets at the same time.

DRAWINGS

FIG. 1 shows a side view of a transport apparatus with zig-zag carrier structures, FIGS. 2 to 4 show, respectively, a folded sheet prior to, during and after making an open loop in the folding process, FIG. 5 shows an apparatus for opening a folded sheet which is shown prior to opening, FIG. 6 shows a side view of the apparatus depicted in FIG. 5, FIG. 7 shows an enlarged portion of the view depicted in FIG. 6, FIG. 8 shows the apparatus depicted in FIG. 5 in the process of opening a folded sheet, FIG. 9 shows the apparatus depicted in FIG. 5 after opening of the folded sheet, FIG. 10 shows a schematic view of a folded sheet within the zig-zag carrier structures, FIG. 11 shows a side view of a transport apparatus with a gripper chain, FIG. 12 shows devices for opening a folded sheet suspended from the gripper chain, FIG. 13 shows a side view of the devices depicted in FIG. 12, and FIG. 14 shows an enlarged portion of the view depicted in FIG. 13.

DETAILED DESCRIPTION

Figure 1:
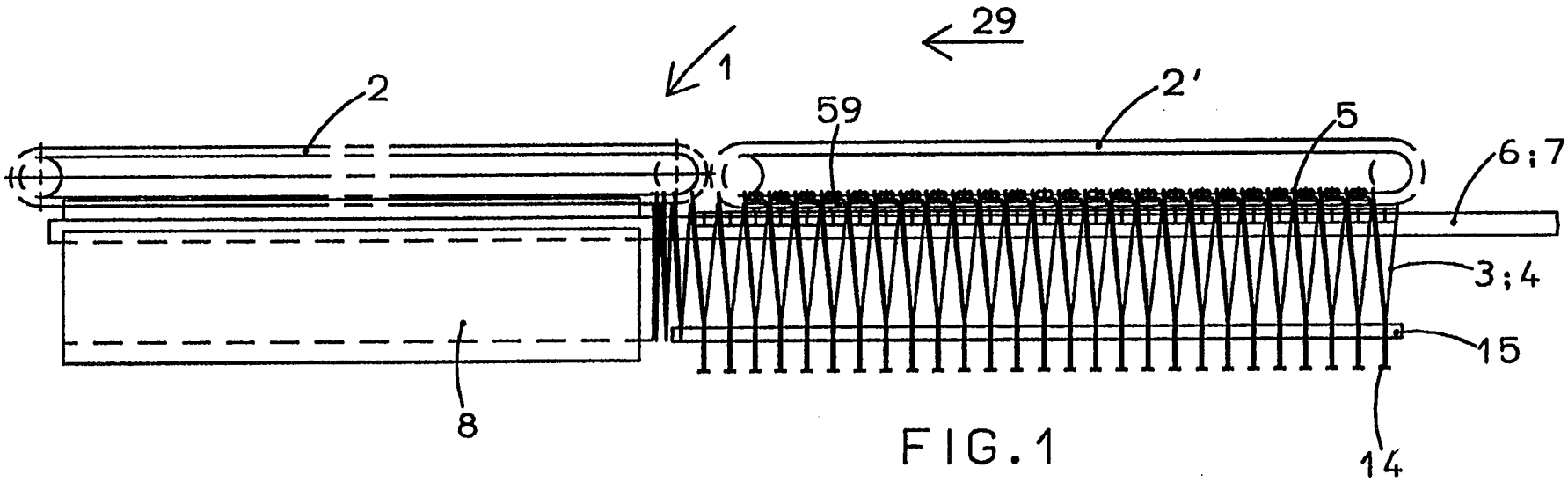
Figure 2:
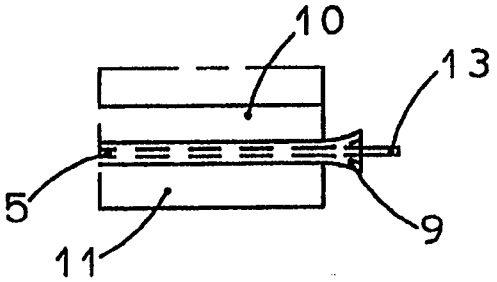
Figure 3:
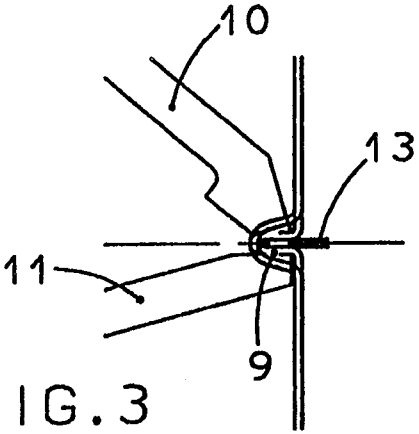
Figure 4:
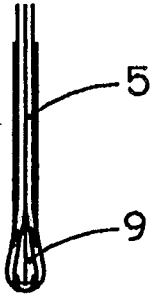

A transport apparatus 1 (FIG. 1) has transport chains 2 and 2'. With their aid, zig-zag carrier structures 3, 4 for the transport of folded sheets 5 are moved by means of catchers 59. The carrier structures 3, 4 with the folded sheets 5 are pulled by the transport chains 2, 2' out of storage cassettes 8 on rails 6 or 7. The transport apparatus 1 and the storage cassettes 8 are disclosed in U.S. Pat. No. 4,840,365. To ease the subsequent sheet opening operation, the folded sheet 5 has an open loop 9 (FIGS. 3, 4), known per se, which is created in the folding process, for example in a folding apparatus, with the aid of folding flaps 10 and 11 as well as a folding blade 13 (FIGS. 2, 3), when the fold is not continued to the edge of the folded sheet 5, such as shown particularly by the view from below on the folded sheet 5 in FIG. 2.

Figure 5:
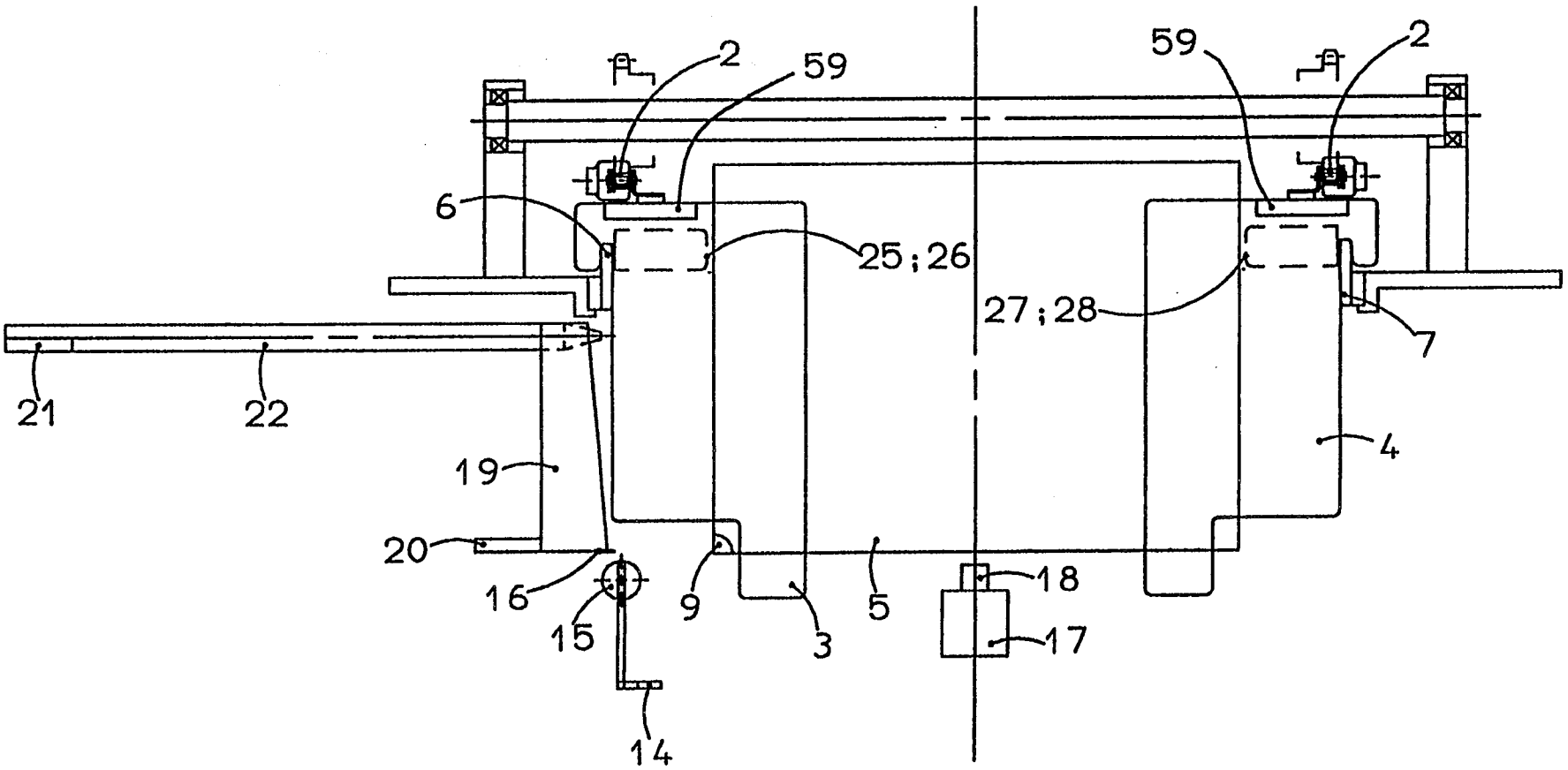

FIG. 5 shows the position of a folded sheet 5 within the zig-zag structures 3 and 4 after they have been pulled out of the storage cassette 8. Y-shaped stops 14 (see FIG. 6) are fastened on a spindle 15. Grippers 18 seated on a gripper bar 17 are located below the folded sheets 5. Insertion needles 16 which can be inserted into the open loops 9 of the folded sheets 5 are seated, together with V-shaped opening plates 19, on a rail 20. Opening bolts 22 are disposed on a rail 21 and are also used for opening the folded sheets 5.

Figure 6:
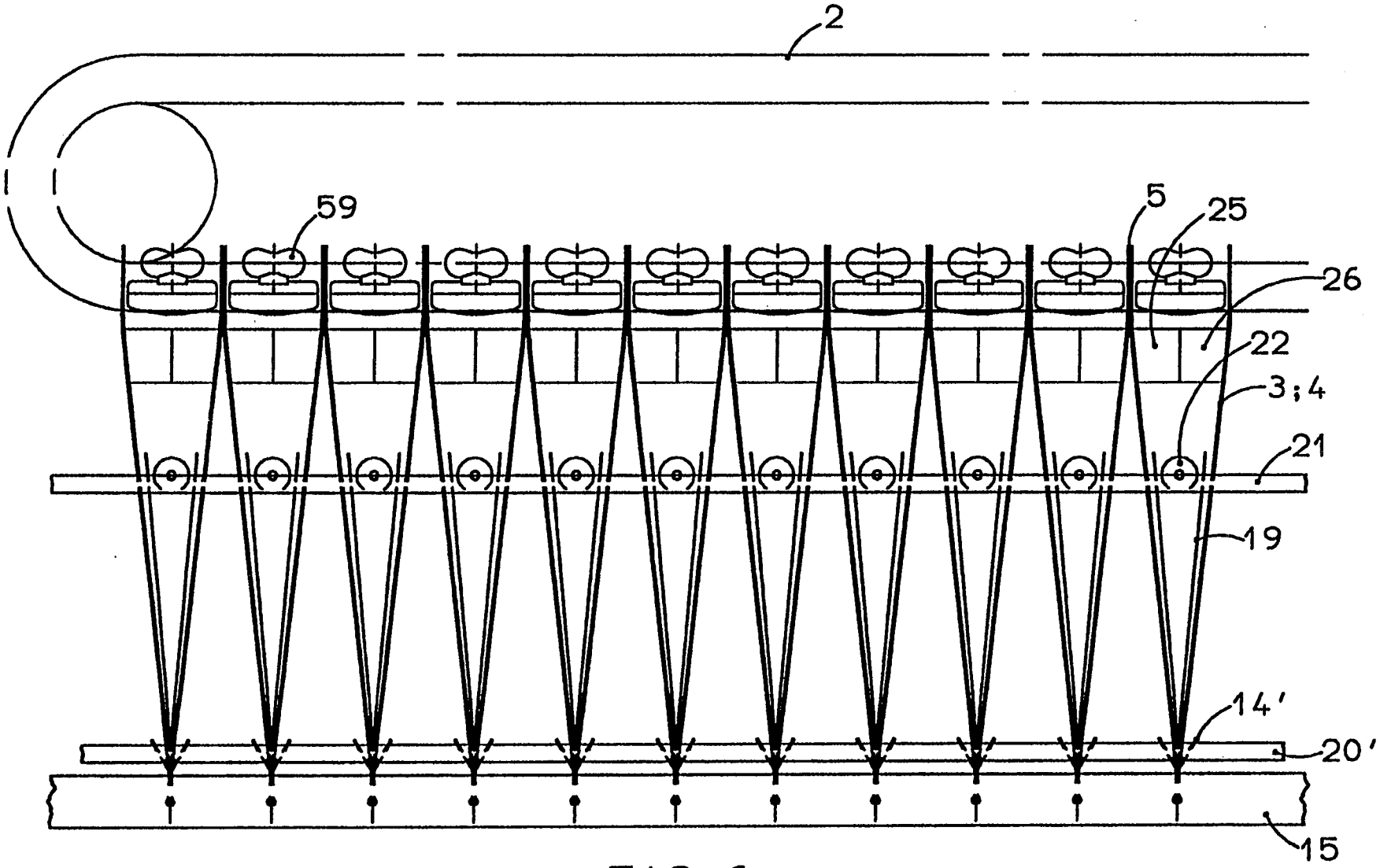
Figure 7:
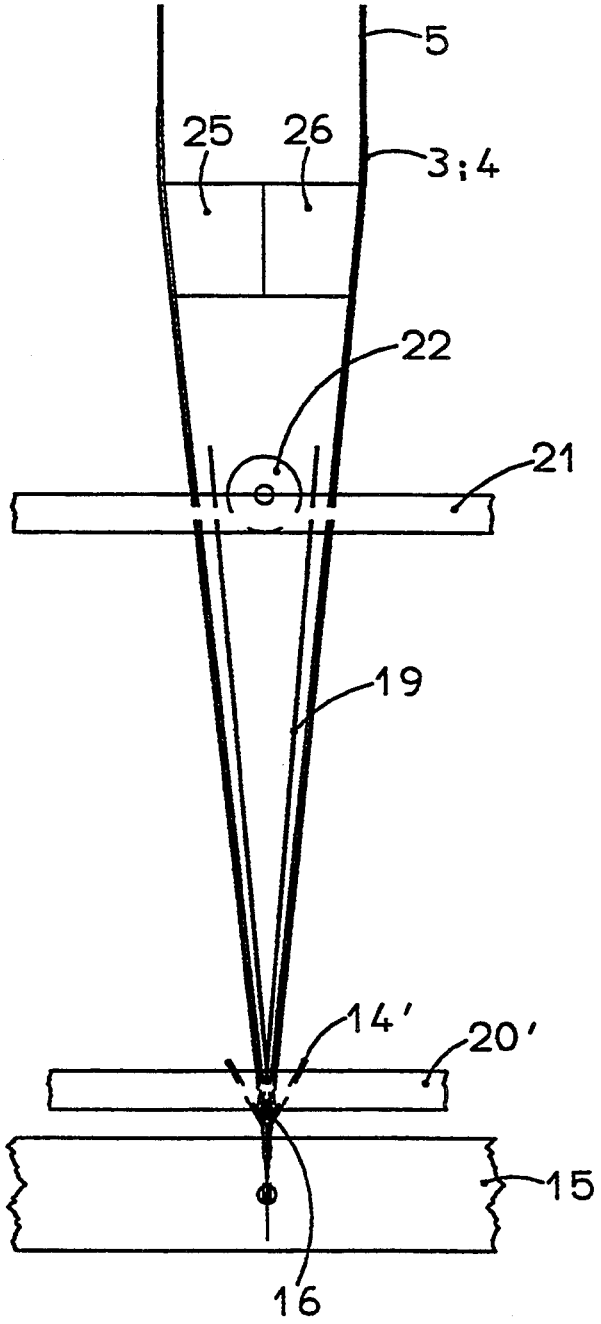
Figure 10:
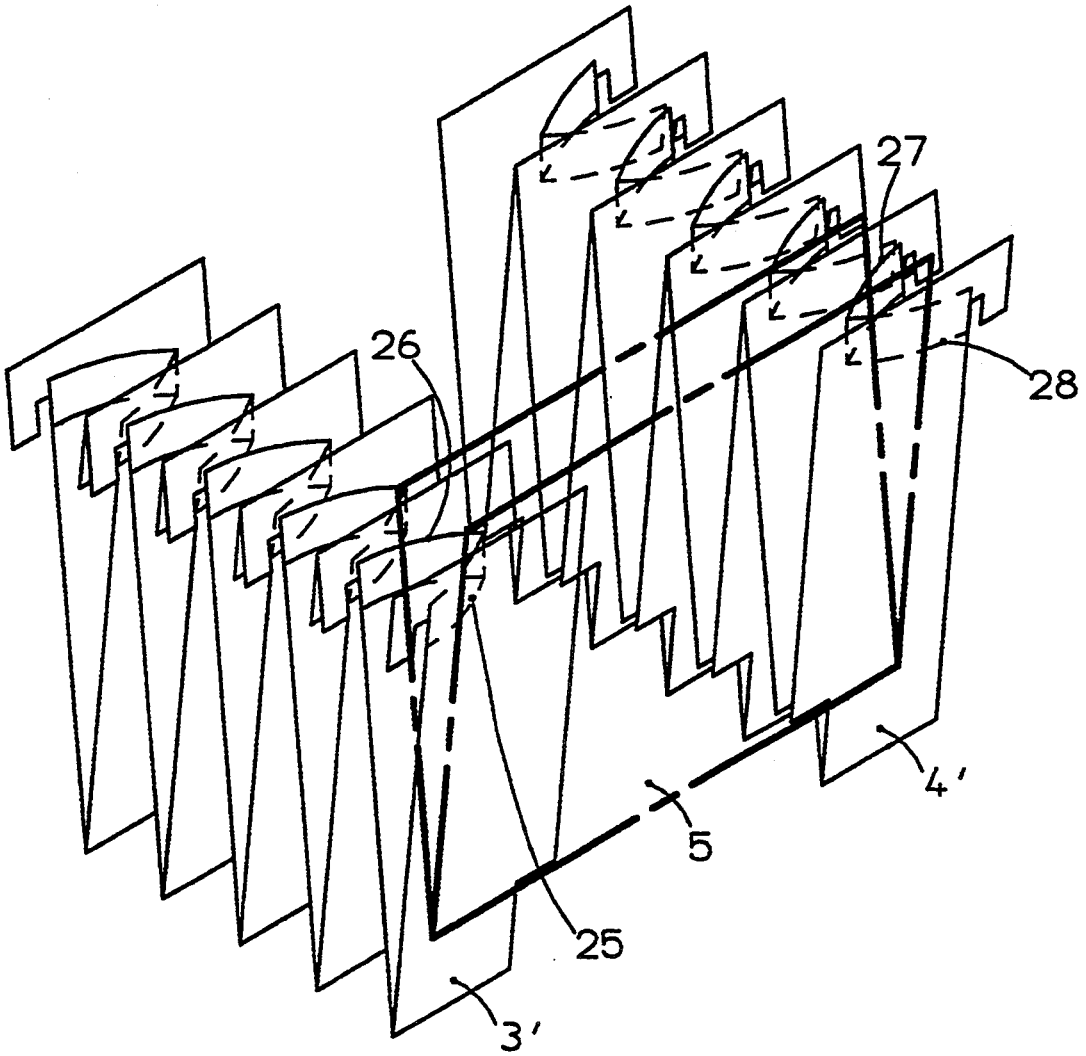

The zig-zag carrier structures 3, 4 have fingers 25, 26 or 27, 28, which can be seen in FIGS. 5 to 7 in particular. The fingers 25, 26 or 27, 28 are elastic and connected with each other (i.e. 25 and 26 are connected to each other, and 27 and 28 are connected to each other, as shown schematically in FIG. 10) on the inside in the shape of a V, so that they spread when pulling the zig-zag carrier structures 3, 4 apart (FIG. 10).

Figure 8:
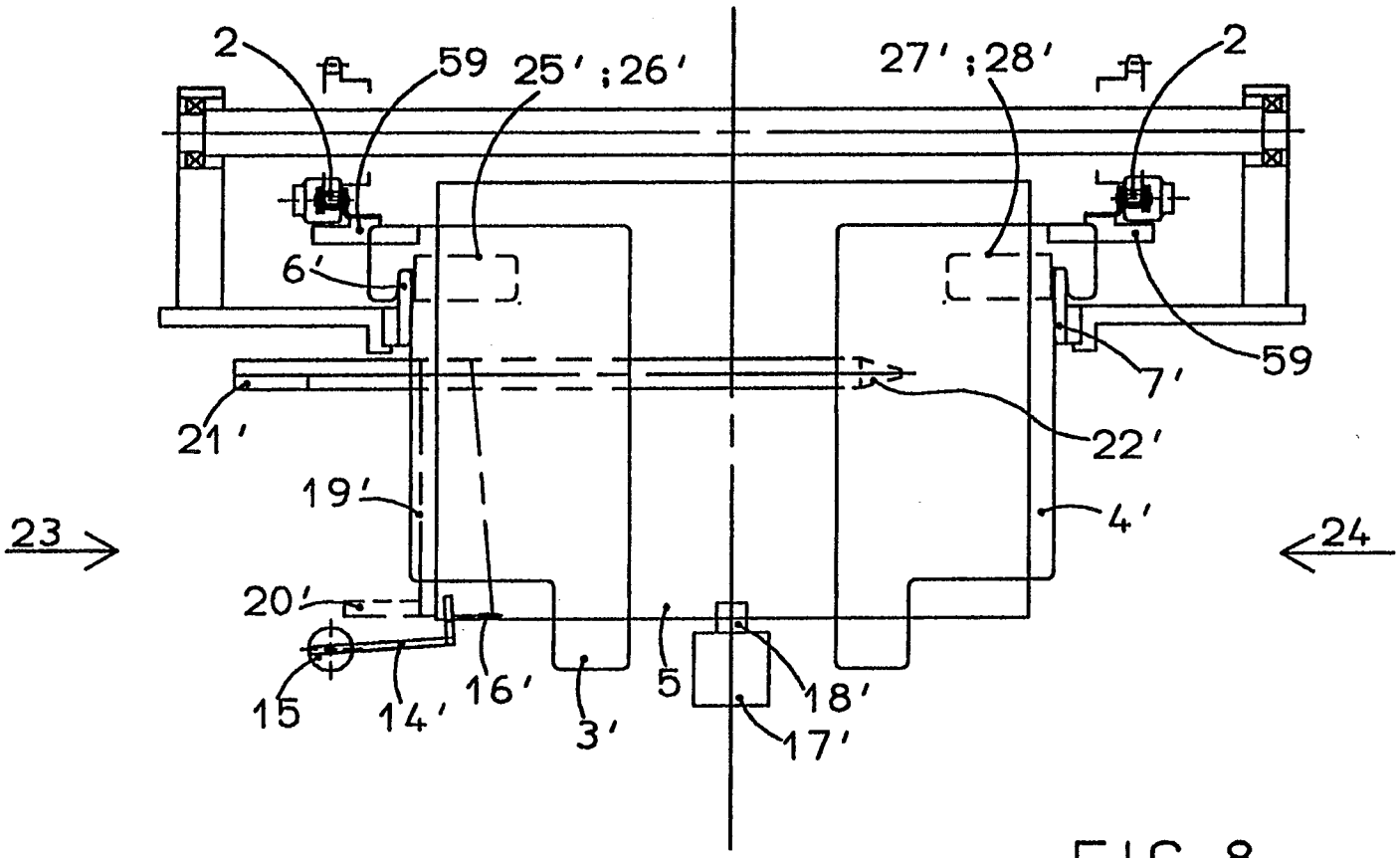

When movement of the zig-zag carrier structures 3, 4 is halted, the stop 14 is pivoted from the position shown in FIG. 5 into the position 14' (FIG. 8), so that it respectively grips the underside of the folded sheet 5 and pushes it slightly upward. Thus, the position of the folded sheet 5 is adjusted such that the open loop 9 is aligned with the center of the insertion needle 16. By displacing the gripper bar 17 into a position 17' (FIG. 8), the gripper 18 moves to a position 18' to grasp the folded sheet 5 and hold it. Then, rail 20 (FIG. 5) is displaced into position 20' (FIG. 8) and simultaneously with it the opening plate 19 (FIG. 5) is moved into position 19' (FIG. 8) and the insertion needle 16 (FIG. 5) into position 16' (FIG. 8), because of which each folded sheet 5 is simultaneously opened in a V-shape. The rail 21 (FIG. 5) is displaced into a position 21'

(FIG. 8), so that the opening bolt 22 seated on it arrives at a position 22'. Because of this the folded sheet 5 is opened over its entire width. Finally, the zig-zag carrier structures 3 and 4 are brought into positions 3' or 4' (FIG. 8) by movement in the opposed direction of arrows 23 or 24, i.e. they are pushed together, in the course of which their fingers 25, 26 or 27, 28 arrive at positions 25', 26' or 27', 28' (FIG. 8) between the sheet halves of the folded sheet 5 opened by the bolts 22.

Figure 9:
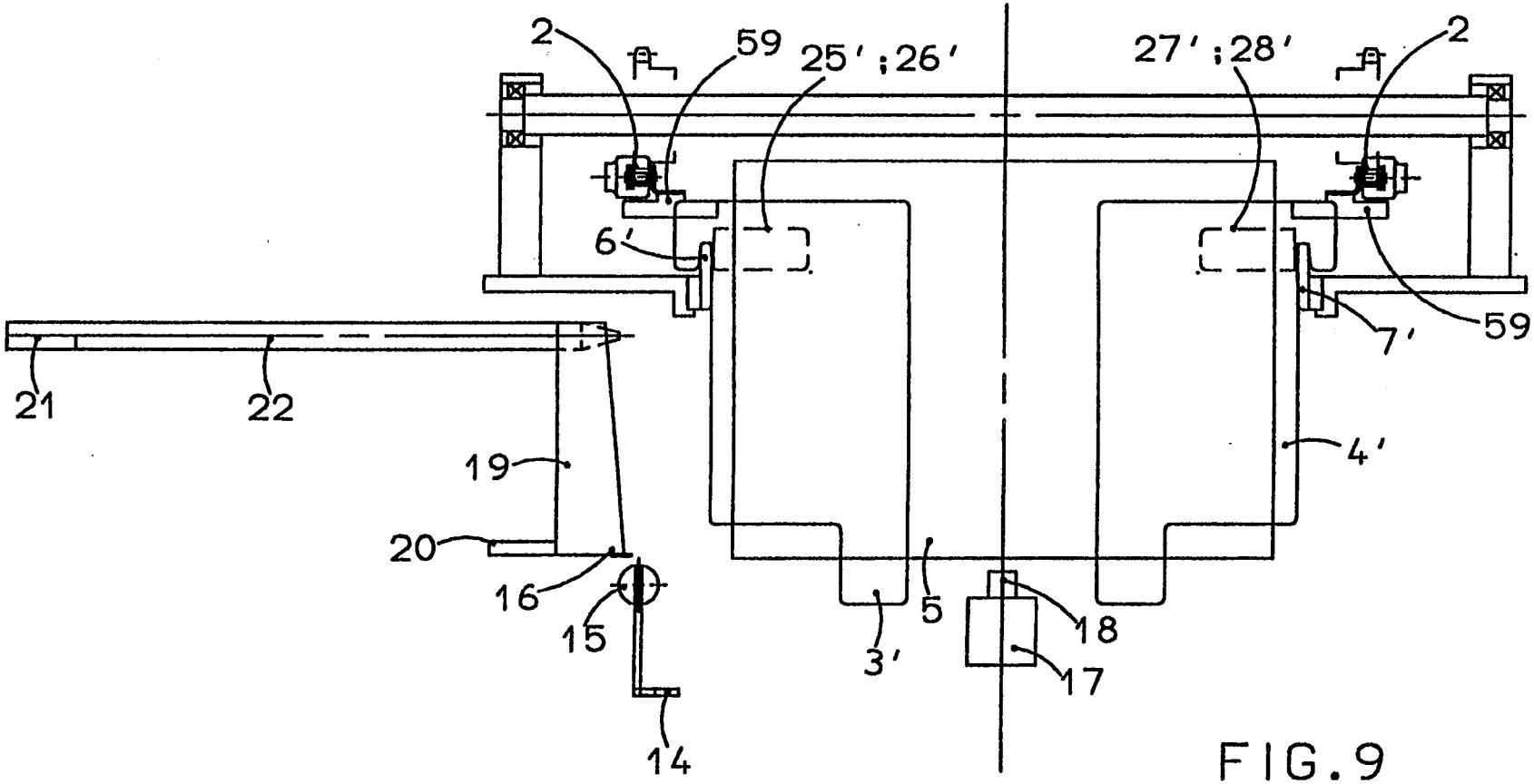

Only the zig-zag carrier structures 3, 4 remain in the positions 3', 4', while all remaining structural elements, i.e. the stops 14, the insertion needles 16, the opening plates 19, the rails 20, 21 and the opening bolts 22 are returned again into their initial position (FIG. 9).

FIG. 10 shows how in positions 3' or 4' the fingers 25, 26 or 27, 28 of the zig-zag carrier structures 3, 4 extend out of the folded sheets 5. In this state the zig-zag carrier structures 3, 4 are pushed together with the aid of the transport chains 2, 2' in the direction of an arrow 29 (FIG. 1) counter to the pull-out direction and stored in the storage cassettes 8. In this state the folded sheets 5 can be pulled out again from the storage cassettes 8 at any time, for example for inserting other sheets into them.

Figure 11:
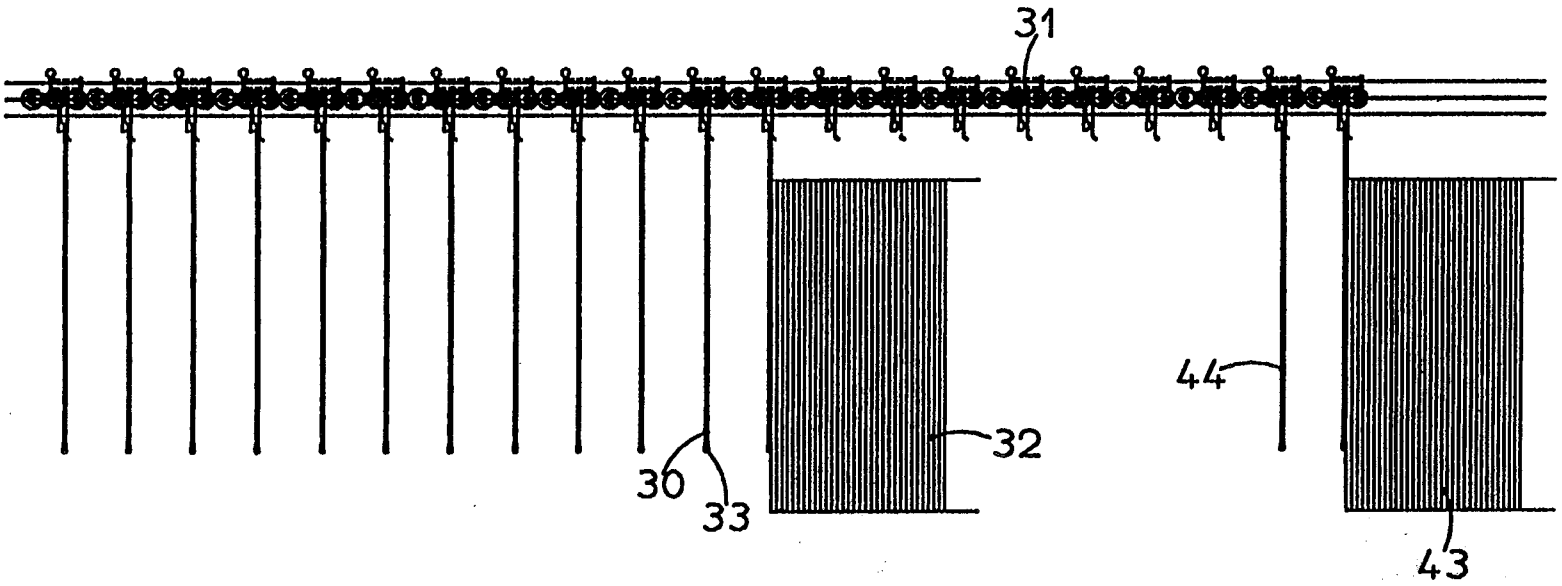
Figure 12:
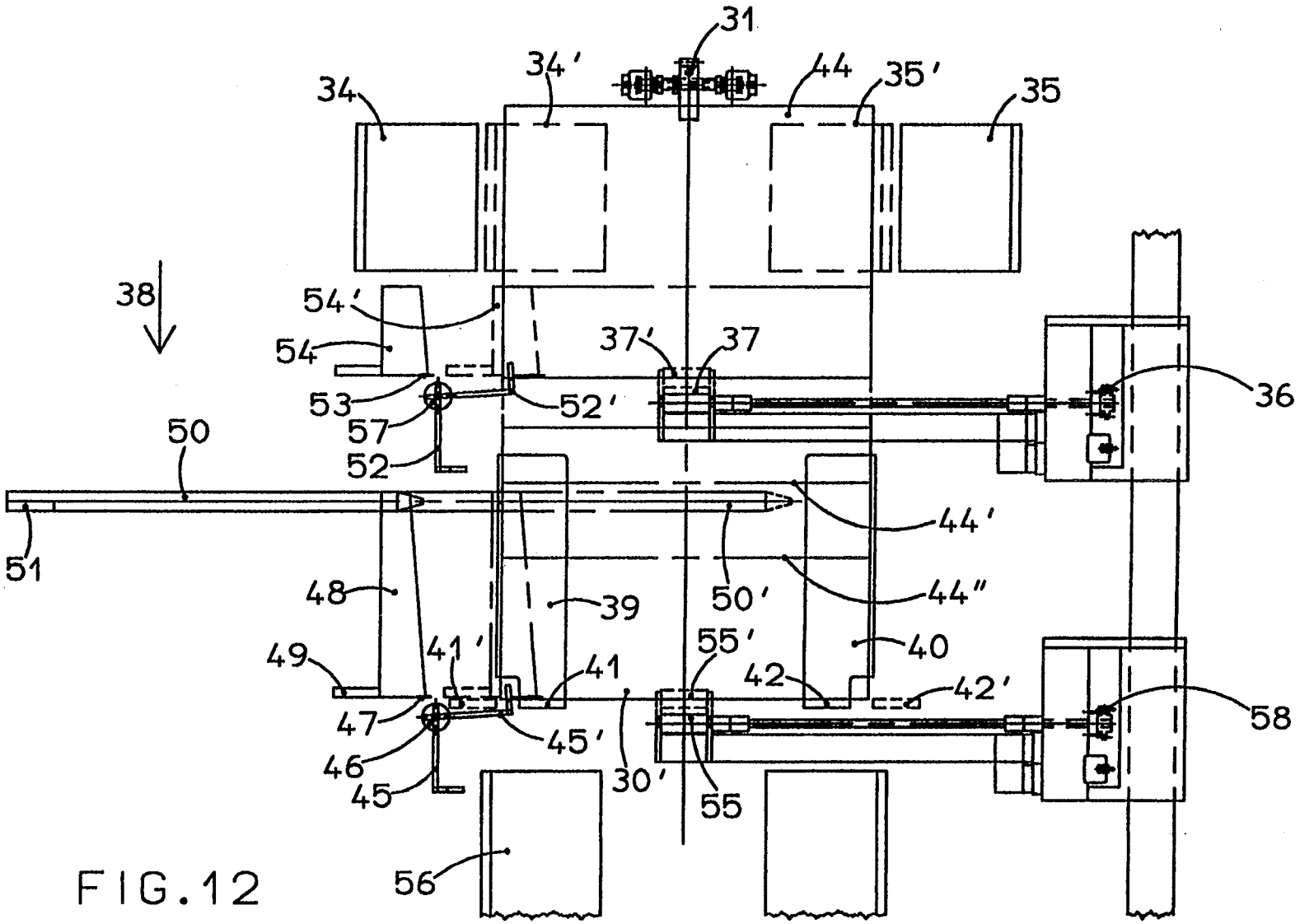

In another apparatus (FIG. 11), folded sheets 30 are taken off a stack 32 and suspended in a gripper chain 31. They had been folded in the same manner as the folded sheets 5 (see FIGS. 2 to 4), so that they have an open loop 33. Another stack 43, for example, is present next to the stack 32, from which the gripper chain 31 takes other folded sheets 44, for example. When the folded sheets 30 take up a predetermined position and the gripper chain 31 is stopped, guide panels 34, 35 (FIG. 12) are moved into positions 34' or 35' between the folded sheets 30. Pairs of rollers 37, when moved to a position 37' and being mutually driven by a chain 36, grip the folded sheets 30 and transport them in the direction of arrow 38 between stationary Y-shaped guide plates 39, 40 into positions 30'. In this position, the folded edge of the folded sheets 30 rests on rails 41 and 42. While the gripper chain 31 brings the folded sheets 44 from the stack 43, spindle 46 pivots Y-shaped stop 45 into position 45' to align the open loops 33 of folded sheets 30 in the position 30' with the center of insertion needles 47. The folded sheets 30 are pushed slightly upward, for example, and the open loops 33 are preferably also pushed apart. By pushing the insertion needles 47, together with V-shaped opening plates 48, on a common rail 49 into positions 47', 48' and 49' inside the folded sheets 30, the latter are opened laterally so that elongated opening bolts 50 can be brought into positions 50' by moving on a rail 51 and in this way open the folded sheets 30 over their entire width while they are simultaneously kept in a position 55' by pairs of rollers 55. The pairs of rollers 55 are driven by a chain 58.

In the course of the above-described operations, the folded sheets 44 also reach the position in which they are opened. While the stops 45, the insertion needles 47 and the opening plates 48 return to their respective initial positions, the opening bolts 50 remain in their positions 50'.

Opening of the folded sheets 44 is initiated in that Y-shaped stops 52 seated on a spindle 57 are pivoted into a position 52'. Then, the folded sheets 44 are laterally opened by the engagement of insertion needles 53 and opening plates 54, which move into positions 54'. The folded sheet 44 is kept in position 37' by the pair of rollers 37. The guide plates 34, 35 are moved into positions 34' or 35' and the pairs of rollers 37 transports the folded sheet 44 in the direction of the arrow 38 into position 44', in which it enters between the halves of the folded sheet 30 which has already been opened in the position 30'. In the position 44', the folded sheet 40 is still above the opening bolts 50 in the positions 50'. After the latter have been retracted into their initial position by the rail 51, the pair of rollers 37 transports the folded sheet 44 into position 44''.

Figure 13:
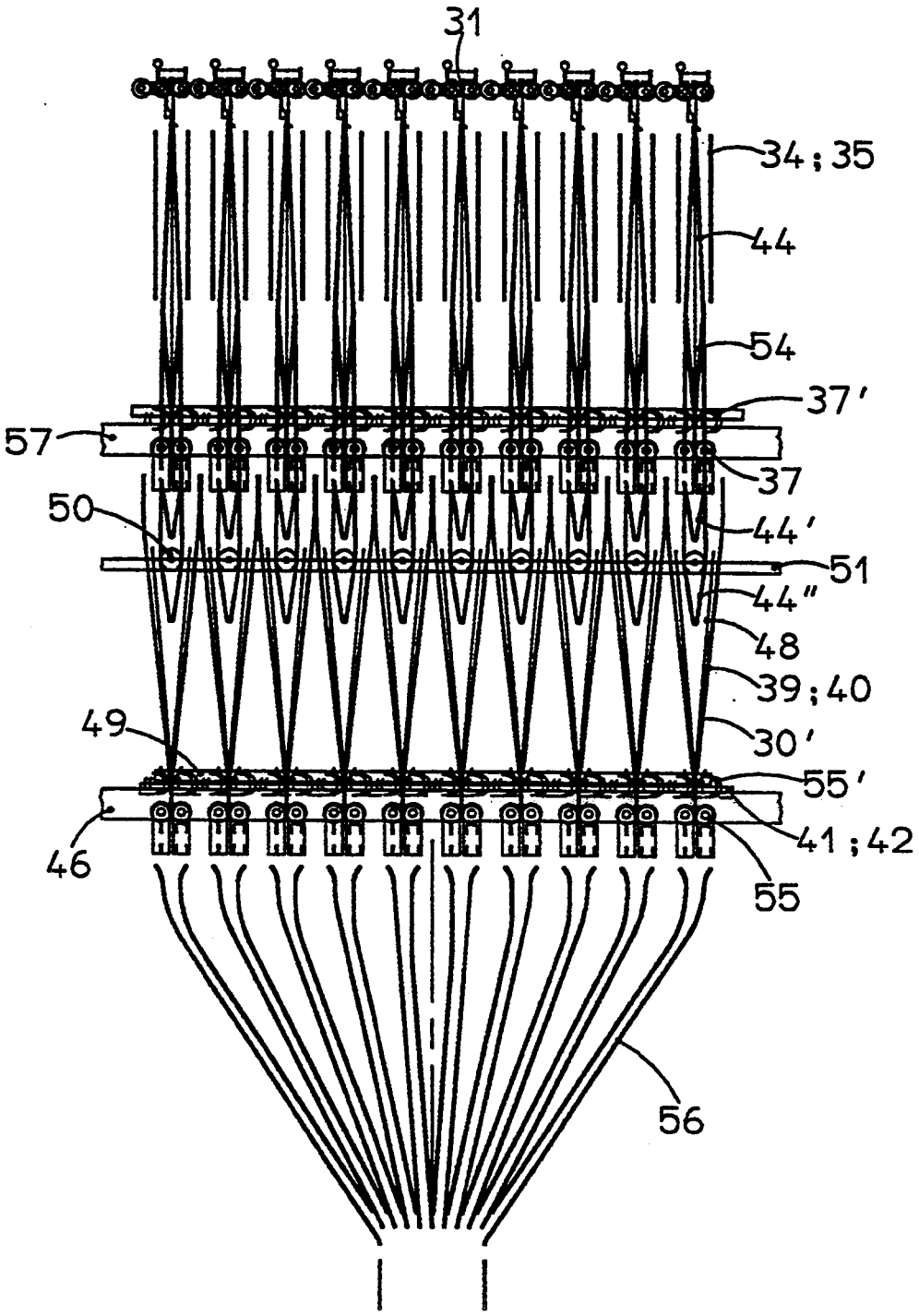
Figure 14:
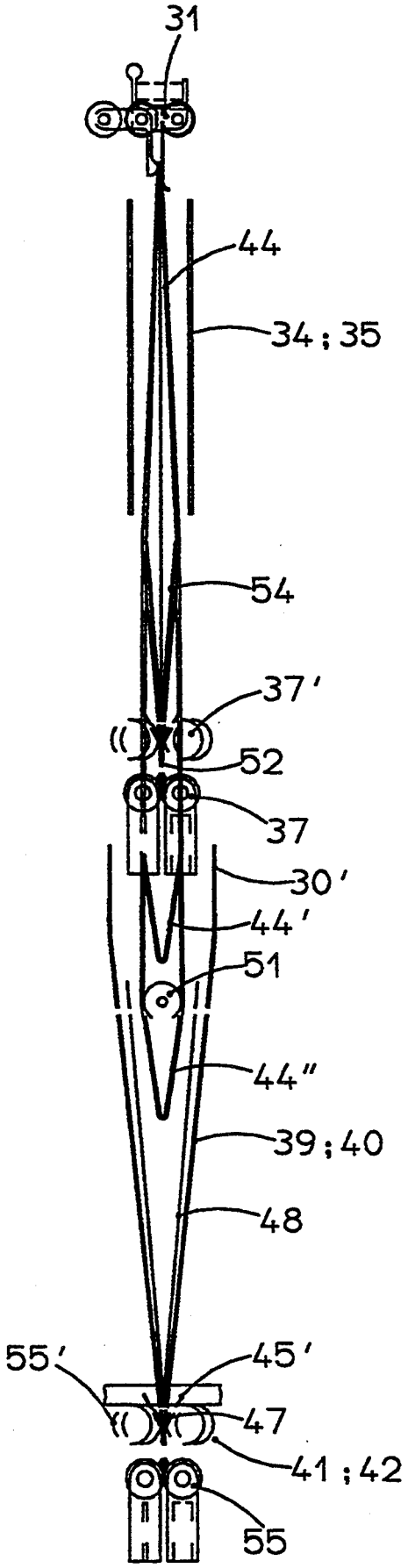

As can be seen in FIG. 13 and FIG. 14 in particular, the folded sheets remain laterally opened even in the positions 44' and 44'' because of the opening plates 54 extending into them in the positions 54'. Subsequently the opening bolts 50 again move into the positions 50' and thus open the folded sheets 44 also over their entire width.

In the same way in which the folded sheets 44 are inserted into the folded sheets 30, the folded sheets 44 can be replenished as often as desired by fresh folded sheets. Subsequently the folded sheet packages created by this are brought by the pairs of rollers 55 and the guide fingers 56 into a packaging apparatus such as known from U.S. Pat. No. 5,129,781. For this purpose the lower rails 41, 42 are moved into the positions 41' or 42'.

In accordance with the above described invention, a number of engagement elements in the form of insertion needles 16, 47, 53 and opening plates 19, 48, 54 corresponding to the number of folded sheets 5, 30, 44 to be processed can be provided, which simultaneously and in parallel open the folded sheets 5, 30, 44 with the aid of the open loops 9, 33 in the fold.

Various modifications will occur readily to one with ordinary skill in the art, and features described in connection with any one of the embodiments may be used with any of the others. Such modifications are all intended to fall within the scope of the present invention as defined by the following claims.

I claim:

1. An apparatus for opening folded sheets (5, 30, 44), wherein each of the folded sheets has been formed with a partly creased fold leaving an open loop (9, 33) between the sheet halves, comprising a plurality of engagement means for insertion into the respective open loops of a plurality of the folded sheets; and control means for the simultaneous, parallel insertion of said engagement means into the open loops (9, 33) during a halt in transport of the folded sheets.

2. An apparatus in accordance with claim 1, wherein said engagement means includes adjusting means for aligning each of the folded sheets (5, 30, 44) to a predetermined position.

3. An apparatus in accordance with claim 2, wherein said adjusting means includes a Y-shaped stop (14, 45, 52) fastened on a spindle (15, 46, 57) and adapted to be pivoted under a folded sheet (5, 30, 44).

4. An apparatus in accordance with claim 3 further comprising holding means to grasp the folded sheets.

5. An apparatus in accordance with claim 4, wherein the holding means includes grippers (18) seated on a gripper bar (17) and grasping the folded sheets (5, 30, 44) by displacement of the gripper bar (17).

6. An apparatus in accordance with claim 4, wherein the holding means includes pairs of rollers (37, 55) driven by a chain (36, 56).

7. An apparatus in accordance with claim 6, wherein the engagement means includes V-shaped opening plates (19, 48, 54) disposed on a first rail (20, 49).

8. An apparatus in accordance with claim 7 wherein the engagement means includes opening bolts (22, 50) disposed on a second rail (21, 51).

9. An apparatus in accordance with claim 6 wherein the engagement means includes insertion needles (16, 47, 53).

10. An apparatus in accordance with claim 1, further comprising holding means to grasp the folded sheets.

11. An apparatus in accordance with claim 10, wherein the holding means includes grippers (18) seated on a gripper bar (17) and grasping the folded sheets (5, 30, 44) by displacement of the gripper bar (17).

12. An apparatus in accordance with claim 10, wherein the holding means includes pairs of rollers (37, 55) driven by a chain (36, 56).

13. An apparatus in accordance with claim 1, wherein the engagement means includes V-shaped opening plates (19, 48, 54) disposed on a first rail (20, 49).

14. An apparatus in accordance with claim 13 wherein the engagement means includes opening bolts (22, 50) disposed on a second rail (21, 51).

15. An apparatus in accordance with claim 14 wherein the engagement means includes insertion needles (16, 47, 53).

16. An apparatus in accordance with claim 1, wherein the engagement means includes opening bolts (22, 50) disposed on a second rail (21, 51).

17. An apparatus in accordance with claim 1, wherein the engagement means includes insertion needles (16, 47, 53).

18. A method for opening folded sheets (5, 30, 44) which have been formed with a partly creased fold leaving an open loop between the sheet halves, comprising the steps of:

transporting the folded sheets;

halting transport of the sheets; and during such halt in transport of the sheets, inserting a plurality of engagement means in the open loop of a plurality of the folded sheets, respectively, simultaneously and in parallel to open said folded sheets.

19. A method in accordance with claim 18, further comprising the steps of:

after said inserting step, pushing zig-zag carrier structures (3, 4) having fingers (25, 26, 27, 28) between the folded sheets (5) so the fingers (25, 26, 27, 28) enter between the sheet halves of the folded sheets (5).

* * * * *